US006098703A

United States Patent [19]

Yoshii

[11] Patent Number: 6,098,703

[45] Date of Patent: Aug. 8, 2000

[54] LAMINATION TYPE HEAT EXCHANGER HAVING REFRIGERANT PASSAGE DIVIDED BY INNER FIN INTO SUBPASSAGES

[75] Inventor: Keiichi Yoshii, Anjo, Japan

[73] Assignee: DENSO Corporation, Kariya, Japan

[21] Appl. No.: 09/190,914

[22] Filed: Nov. 12, 1998

[30] Foreign Application Priority Data

Dec. 10, 1997 [JP] Japan ..... 9-340314

[51] Int. Cl.[7] ..... F28D 1/02

[52] U.S. Cl. ..... 165/153; 165/174

[58] Field of Search ..... 165/153, 146, 165/134.1, 174

[56] References Cited

U.S. PATENT DOCUMENTS 4,570,700 2/1986 Ohara et al. ..... 165/134.1
5,152,337 10/1992 Kawakatsu et al. ..... 165/153
5,172,759 12/1992 Shimoya et al. ..... 165/153
5,701,760 12/1997 Torigoe et al. .

FOREIGN PATENT DOCUMENTS 63-175769 U 11/1988 Japan .

*Primary Examiner*—Christopher Atkinson
*Attorney, Agent, or Firm*—Harness, Dickey & Pierce, PLC

[57] ABSTRACT

A refrigerant passage formed by a pair of metallic thin plates therebetween is divided into many subpassages by a corrugated inner fin. The subpassages are independent from one another and are elongated in the longitudinal direction of the thin plates. An inlet tank portion is provided at an end of the refrigerant passage, and communicating portions are provided between the inlet tank portion and the subpassages. One of the communicating portions provided at an air upstream side in an air flow direction has a flow resistance of refrigerant smaller than that of the other communicating portion provided on an air downstream side. Accordingly, an amount of the refrigerant flowing in the subpassages on the air downstream side is controlled to be smaller than that on the air upstream side.

15 Claims, 7 Drawing Sheets

LAMINATION TYPE HEAT EXCHANGER HAVING REFRIGERANT PASSAGE DIVIDED BY INNER FIN INTO SUBPASSAGES

CROSS REFERENCE TO RELATED APPLICATION

This application is based upon and claims the benefit of priority of the prior Japanese Patent Application No. 9-340314, filed on Dec. 10, 1997, the contents of which are incorporated herein by reference.

BACKGROUND OF THE INVENTION

1. Field of the Invention

This invention relates to a lamination type heat exchanger such as an evaporator including several tubes (refrigerant passages) formed by laminating metallic thin plates, which is suitable for a refrigerant evaporator of an automotive air conditioning apparatus.

2. Description of the Related Art

In recent years, in a refrigerant evaporator for an automotive air conditioning apparatus, inner fins are inserted into tubes (refrigerant passages) formed by laminating metallic plates so that a refrigerant side heat transfer area increases. This results in improvement of evaporator characteristics. When the inner fins respectively have a corrugated shape in cross-section, each of the refrigerant passages is divided into several straight-pipe like subpassages, and refrigerant flows independently in the respective subpassages from an inlet portion to an outlet portion without being mixed with the refrigerant flowing in the other subpassages.

The inventors of the present invention examined and studied this type of the evaporator, and found the following problems. First, if the refrigerant is unevenly distributed into the subpassages at the inlet portion, the unevenness of the distribution is kept in the subpassages, and may be encouraged in the subpassages by the following reason.

That is, under ordinal operational conditions of the evaporator, the liquid refrigerant expands to be gaseous refrigerant having a volume approximately 70 times as large as that of the liquid refrigerant so that the flow resistance increases. Therefore, when the gas region of the refrigerant is large in the inner fin subpassages, it become difficult for the refrigerant to flow in the subpassage. In addition, when a distribution amount of the refrigerant distributed into one of the subpassages is short relative to heat load on an air side, the refrigerant starts to evaporate at a refrigerant upstream side more than that in the other subpassages in which the distribution amount of the refrigerant is not short. As a result, the gas region is further increased to encourage the shortage of the refrigerant.

On the other hand, in the subpassage into which the refrigerant is distributed too much, the refrigerant starts to evaporate at a refrigerant downstream side more than that in the subpassage in which the refrigerant is short. Therefore, the gas region becomes relatively small, so that the refrigerant readily flows in the subpassage. This further encourages the excess of the refrigerant. In this way, the shortage and excess of the refrigerant distribution with respect to the air side heat load, which occurs when the evaporator starts, is further encouraged after the heat exchange between the refrigerant and air is carried out. In this case, as compared to a case (ideal state) where the evaporation of the refrigerant (heat exchange) is carried out evenly in every subpassages, the cooling capacity of the evaporator is lowered.

In addition, when the air flows from an air upstream side to an air downstream side in the heat exchanging part, the temperature of the air is gradually decreased. Therefore, an optimum distribution amount of the refrigerant into the subpassages on the air downstream side is inevitably smaller than that on the air upstream side. Therefore, when the refrigerant is evenly distributed into the subpassages, inevitably, the refrigerant becomes short in the subpassages on the air upstream side and becomes excessive in the subpassages on the air downstream side.

SUMMARY OF THE INVENTION

The present invention has been made based on the above problems. An object of the present invention is to improve cooling capacity of a heat exchanger such as an evaporator including several refrigerant passage which are divided by inner fins into many subpassage.

According to the present invention, a fluid passage formed by a pair of thin plates is divided into a plurality of subpassages by an inner fin. The plurality of subpassages includes an upstream side subpassage and a downstream side subpassage which is provided on a downstream side more than the upstream side subpassage in an air flow direction in which air flows outside of the fluid passage. The heat exchanger further has a fluid distribution controlling portion provided between the plurality of subpassages and an inlet tank portion, which is provided at an end of the pair of thin plates to communicate with the plurality of subpassages. The fluid distribution controlling portion controls first and second amounts of fluid respectively distributed into the upstream side and downstream side subpassages such that the second amount of the fluid distributed into the downstream side subpassage is smaller that the first amount of the fluid distributed into the upstream side subpassage.

As a result, the fluid can be appropriately distributed into the plurality of subpassages to comply with air side heat loads varying on the upstream and downstream sides in the air flow direction, resulting in improvement of heat exchanging capacity. The inner fin can be positioned in the fluid passage in the longitudinal direction using the fluid distribution controlling portion. Accordingly, the positioning of the inner fin can be precisely carried out with a simple structure.

When the inlet tank portion is offset toward the upstream side in the air flow direction from a central portion of the pair of thin plates in a width direction of the pair of thin plates, the fluid distribution controlling portion may be provided only on the downstream side in the air flow direction with respect to the inlet tank portion as a communicating portion.

The fluid distribution controlling portion can have a first communicating portion directly communicating with the upstream side subpassage and a second communicating portion directly communicating with the downstream side subpassage. The first communicating portion has a flow resistance of the fluid smaller than that of the second communicating portion. In this case, only the second communicating portion can have a resistive member for restricting the fluid from being introduced into the subpassages.

The first and second communicating portions can be defined by the pair of thin plates therebetween. When a gap between the pair of thin plates forming the first communicating portion is larger than that forming the second communicating portion, the first communicating portion can provide the flow resistance of the fluid smaller than that of the second communicating portion.

BRIEF DESCRIPTION OF THE DRAWINGS

Other objects and features of the present invention will become more readily apparent from a better understanding of the preferred embodiments described below with reference to the following drawings.

DETAILED DESCRIPTION OF THE PREFERRED EMBODIMENTS (First Embodiment)

A refrigerant evaporator 1 in a first preferred embodiment, which is shown in FIGS. 1–5, is for a refrigerating cycle of an automotive air conditioning apparatus. Refrigerant is expanded by a temperature operation type expansion valve (pressure reducing member), which is not shown, to be low temperature and low pressure gas-liquid two-phase refrigerant, and then flows into the evaporator 1.

Figure 1:
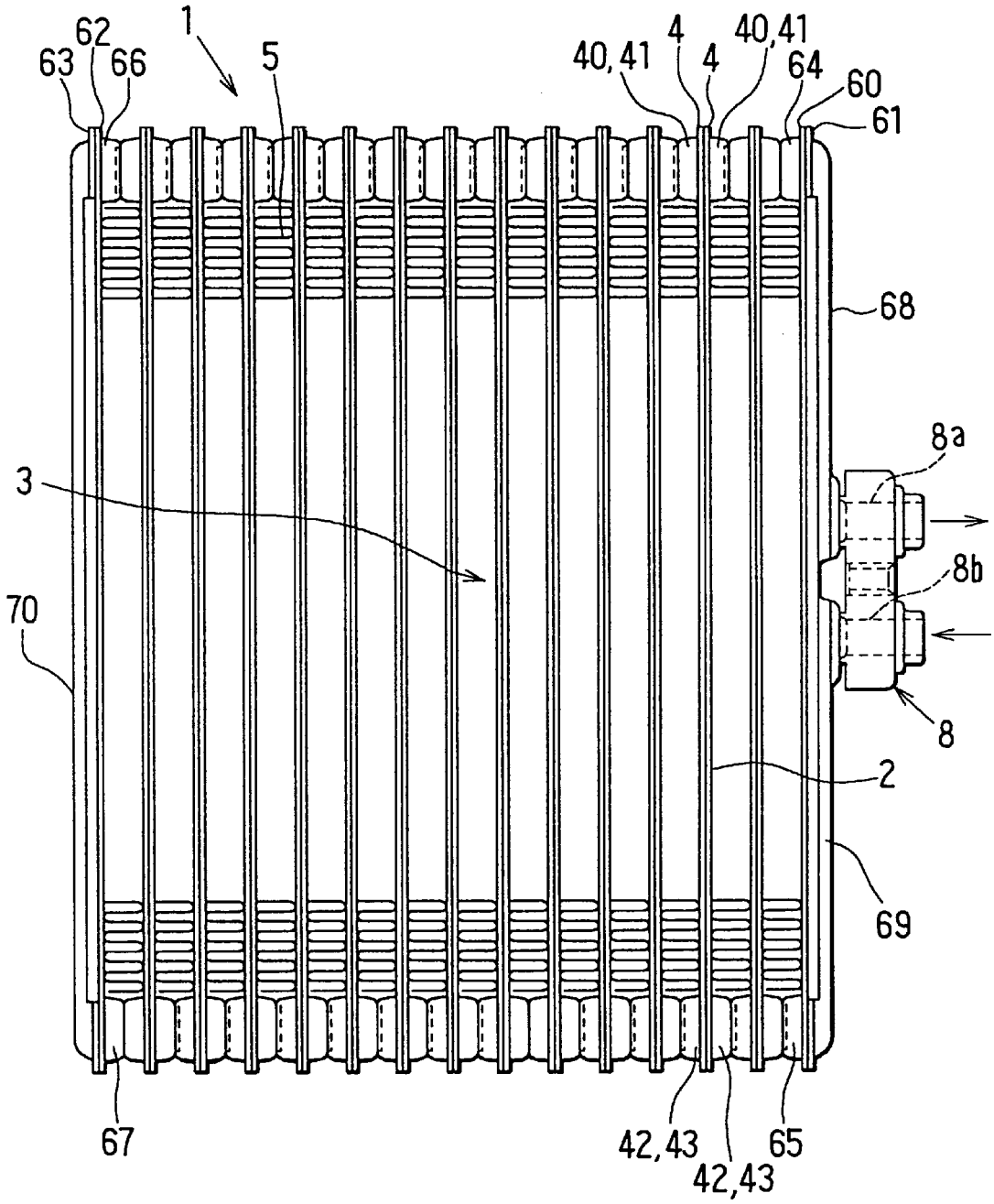
FIG. 1 is a front view showing an evaporator according to the present embodiment.

Referring to FIG. 1, the evaporator 1 is installed within an air conditioning unit case (not shown) of the air conditioning apparatus such that the upper and lower sides in FIG. 1 are set at the upper and lower sides, respectively, in the unit case. Air blown by an air conditioning blower flows in a direction perpendicular to a page space of FIG. 1 (a direction indicated with A in FIG. 2). The evaporator 1 has several tubes 2 which are disposed in parallel and form a heat exchanging part 3 for evaporating refrigerant flowing in the tubes 2 by exchanging heat between the refrigerant and air (outside fluid) flowing outside of the tubes 2. The tubes 2 are formed by laminating metallic thin plates (core plates) 4. The specific lamination structure of the tubes 2 may be substantially the same as a well-known one which is for example disclosed in JP-A-9-170850 filed by the applicant of the present invention. Here, the lamination structure will be briefly explained. Each of the metallic thin plates 4 is a clad member composed of an aluminum core member having surfaces clad with brazing filler metal, and is formed into a specific shape (see FIG. 2). The thus formed thin plates 4 are laminated with one another with several pairs, each of which is composed of two thin plates 4, and brazed to one another so that the tubes 2 are provided in parallel.

Next, referring to FIGS. 2, 3, the specific shape of each thin plate 4 will be explained in more detail. The thin plate 4 has a rib-like central partitioning portion 44 and a rib-like outer peripheral joining portion 45. The central partitioning portion 44 is elongated in a longitudinal direction at the central portion in a width direction of the thin plate 4, and the outer peripheral joining portion 45 is provided entirely around an outer edge portion. Further, concave portions 46 (see FIG. 3) are provided between the central partitioning portion 44 and the outer peripheral joining portion 45 to be recessed more than the faces of the both portions 44, 45 by a specific dimension. Accordingly, when two thin plates 4 are joined to one another at the respective central partitioning portions 44 and the outer peripheral joining portions 45, two refrigerant passages (fluid passages) 47, 48 are provided in parallel on right and left sides of the central partitioning portion 44.

Figure 4A:
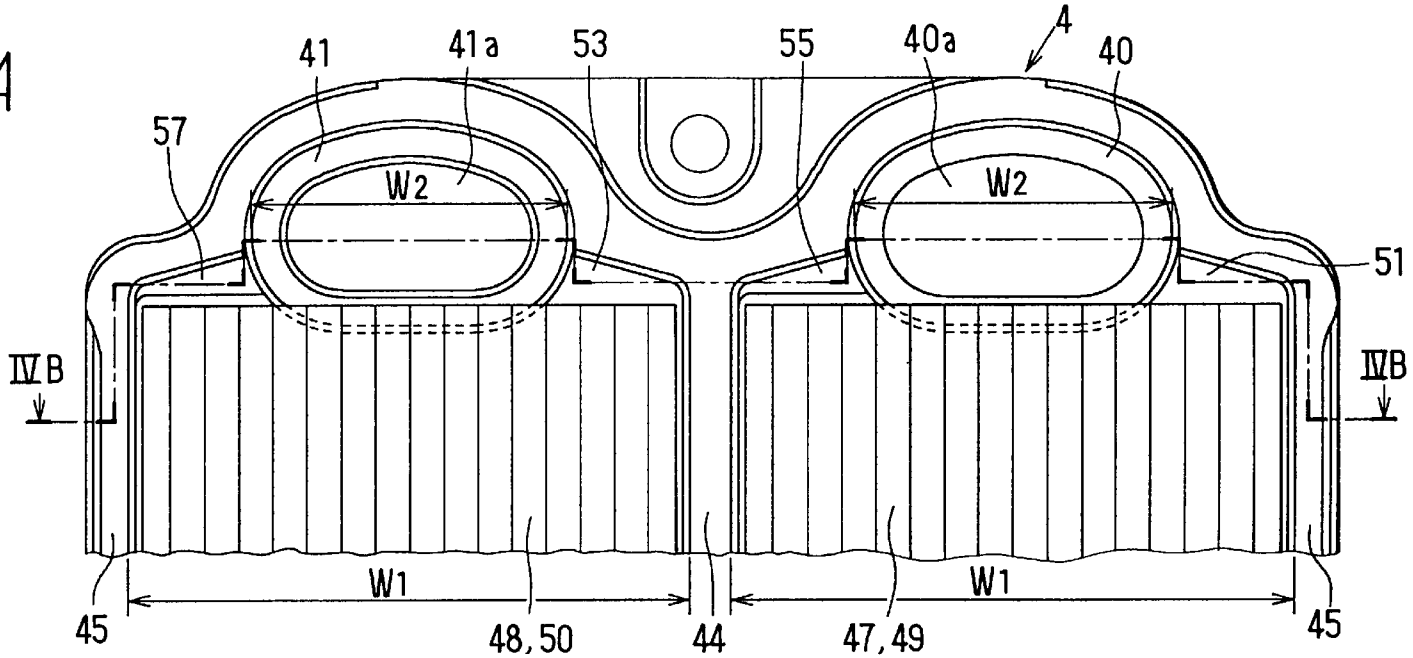
FIG. 4A is an enlarged view shoring a main part of the thin plate shown in FIG. 2.
Figure 4B:
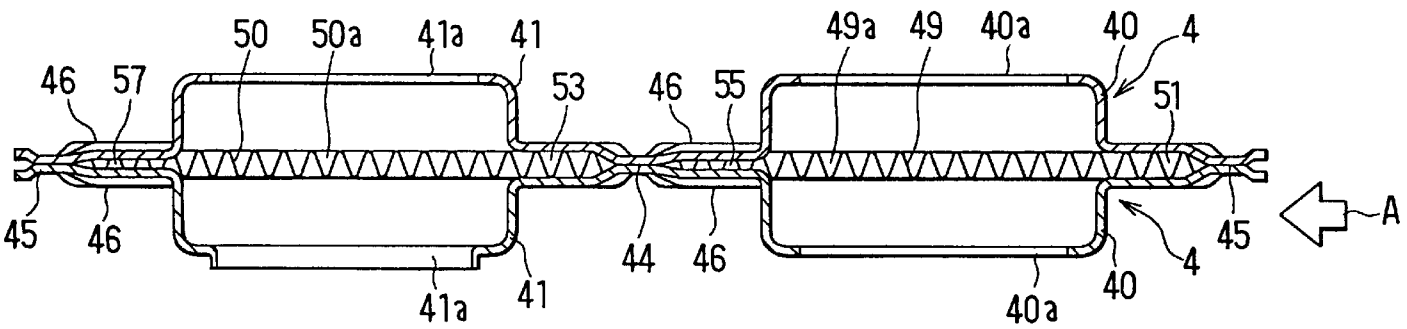
FIG. 4B is a cross-sectional view taken along a IVB—IVB line in FIG. 4A.

As shown in FIG. 4B, the refrigerant passages 47, 48 respectively hold corrugated inner fins 49, 50 therein. Each of the inner fins 49, 50 is composed of an aluminum bare thin plate without being clad with brazing filler metal and is formed into a corrugated shape. The inner fins 49, 50 are disposed such that folded top portions thereof contact the inside walls of the concave portions 46 and the folded top portions are integrally brazed to the inside walls. Accordingly, the refrigerant passages 47, 48 are partitioned by the inner fins 49, 50 to have subpassages 49*a*, 50*a* respectively independent from one another and arranged in a tube width direction (left and right direction in FIG. 2). The refrigerant flows independently in the subpassages 49*a*, 50*a* in a tube longitudinal direction.

Referring again to FIG. 2, each of the thin plate 4 has totally four tank portions 40, 41, and 42, 43 at both ends in the longitudinal direction thereof. The tank portions 40–43 are formed with cup-like protruding portions (see FIG. 4A) protruding outward from corresponding one of the tubes 2 in a lamination direction, and respectively have communication holes 40*a*–43*a* for connecting the refrigerant passages to one another in the tubes 2 at both ends of the refrigerant passages (at the upper and lower end portions in FIG. 1).

Figure 2:
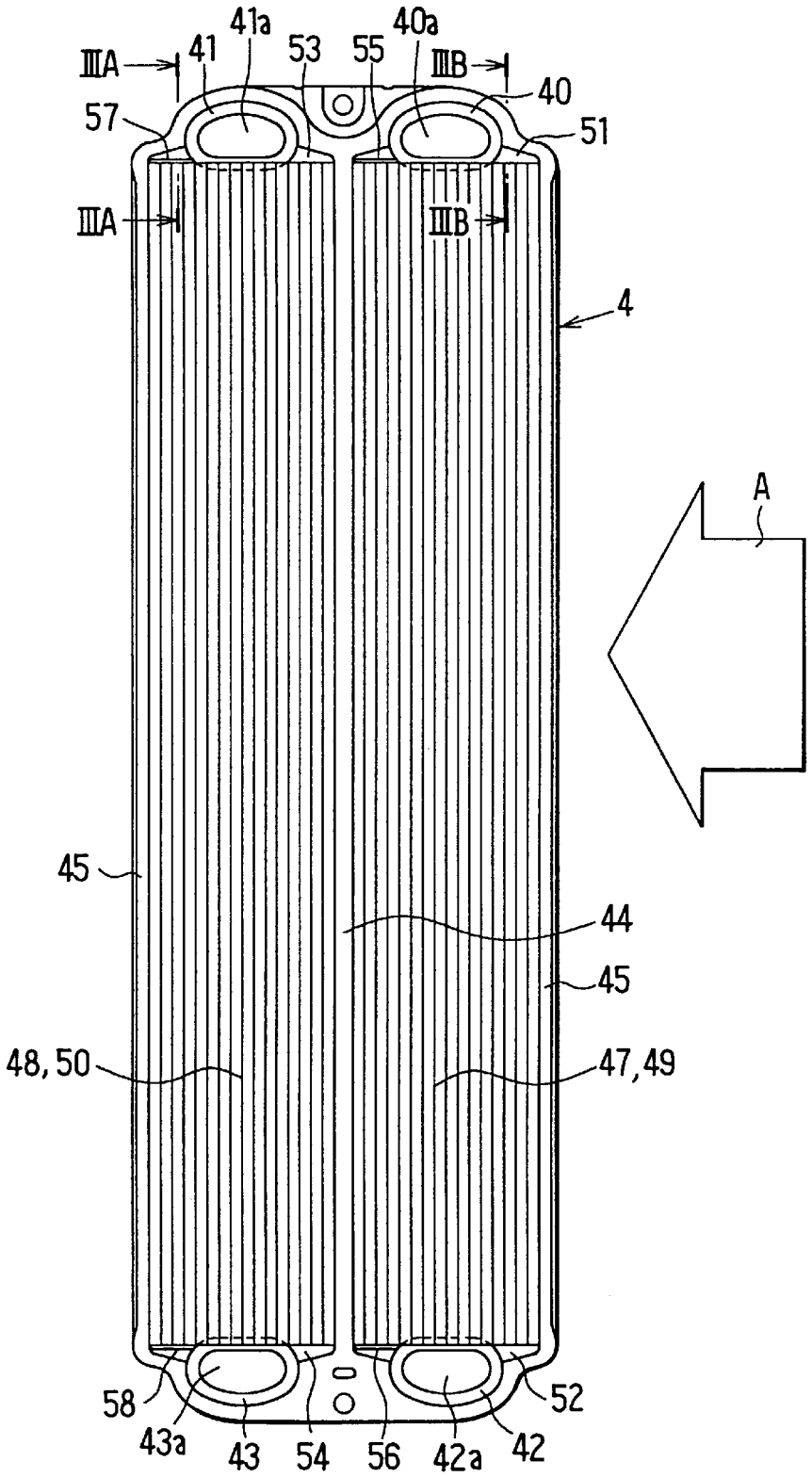
FIG. 2 is a front view showing a metallic thin plate for forming a tube of the evaporator in a first preferred embodiment.
Figure 3A:
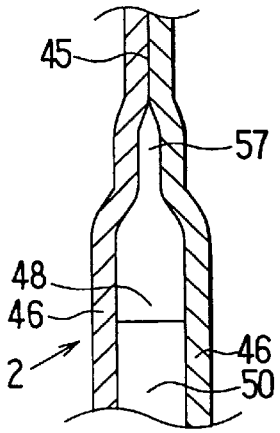
FIG. 3A is a cross-sectional view taken along a IIIA—IIIA line in FIG. 2.
Figure 3B:
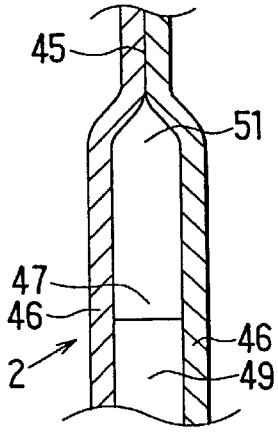
FIG. 3B is a cross-sectional view taken along a IIIB—IIIB line in FIG. 2.

In FIG. 2, the upper side tank portions 40, 41 constitute a refrigerant inlet side tank, and the lower side tank portions 42, 43 constitute a refrigerant outlet side tank. The refrigerant flows in the subpassages 49*a*, 50*a* from the upper side to the lower side. Further, in the first embodiment, the evaporator 1 includes the following communication path scheme (refrigerant distribution controlling portion) between the two refrigerant passages 47, 48 (the inner fin subpassages 49*a*, 50*a*) and the upper and lower tank portions 40–43. That is, as shown in FIGS. 3A, 3B, and 4B, on both sides of the refrigerant passage 47 (the inner fin subpassage 49*a*) and the refrigerant passage 48 (the inner fin subpassage 50*a*), communicating portions (fluid distribution controlling portion) 51–54 provided on an upstream side in an air flow direction A (air upstream side) have cross-sectional areas larger than those of communicating portions 55–58 (fluid distribution controlling portion) provided on a downstream side in the air flow direction A (air downstream side). Specifically, embossed heights of the two thin plates 4 forming the communicating portions 51–58 therebetween are determined such that the gap at the communicating portions 51–54 on the upstream side becomes larger than that at the communicating portions 55–58 on the downstream side.

Meanwhile, as shown in FIG. 1, several corrugated fins (fin members) 5 are disposed in respective spaces between the adjacent two tubes 2 at the heat exchanging part 3 and are joined to the outside surfaces of the tubes 2. Accordingly, a heat transfer area on an air side is increased. The corrugated fins 5 are made of aluminum bare members formed into a corrugated shape without being clad with brazing filler metal thereon. An end plate 60 is positioned at an end (right side end in FIG. 1) in the lamination direction of the metallic thin plates 4 at the heat exchanging part 3 and a side plate 61 is joined to the end plate 60. Further, another end plate 62 is positioned at the other end (left side end in FIG. 1) in the lamination direction, and another side plate 63 is joined to the end plate 62. The end plates 60, 62, and the side plates 61, 63 are made of clad members similarly to the metallic thin plates 4; however, it should be noted that each thickness of the plates 60–63 is thicker than that of the metallic thin plates 4, and is for example approximately 1 mm. This is because the plates 60–63 need to have mechanical strength larger than that of the metallic thin plates 4.

The end plates 60, 62 also have tank portions 64–67 similar to the tank portions 40–43 of the metallic thin plates 4. The right-side side plate 61 is divided into upper and lower parts to have first and second overhanging portions 68, 69 for forming side refrigerant passages 14, 15 (see FIG. 5). The left-side side plate 63 has an overhanging portion 70 forming a side refrigerant passage 13 (see FIG. 5). A piping joint 18 is joined to the right-side side plate 61 between the lower end of the first overhanging portion 68 and the upper end of the second overhanging portion 69. The piping joint 18 is formed from an aluminum bare member into an elliptically shaped block body having a refrigerant outlet hole 8*a* and a refrigerant inlet hole 8*b* passing through in a thickness direction of the block body.

The refrigerant outlet hole 8*a* is open within the first overhanging portion 68 to communicate with the lower end portion of the side refrigerant passage 14. The refrigerant inlet hole 8*b* is open within the second overhanging portion 69 to communicate with the upper end portion of the side refrigerant passage 15. In this embodiment, the refrigerant outlet and inlet holes 8*a*, 8*b* of the piping joint 8 are arranged in the longitudinal direction of the side plate 61. The refrigerant inlet hole 8*b* is connected to an outlet side refrigerant pipe of an expansion valve that is not shown, and the refrigerant outlet hole 8*a* is connected to a suction pipe of a compressor that is also not shown.

Next, a manufacturing method of the evaporator in this embodiment will be briefly explained. First, the parts of the evaporator 1 such as the metallic thin plates 4 and the corrugated fins 5 for forming the tubes 2 are temporarily assembled into a state shown in FIG. 1. The temporarily assembled body is installed in a brazing furnace while being kept its temporarily assembled state using a specific jig or the like. Then, the temporarily assembled body is heated up to a melting point (around 600° C.) of the brazing filler metal of the aluminum clad members, so that the joining portions of the evaporator 1 are integrally brazed.

Figure 5:
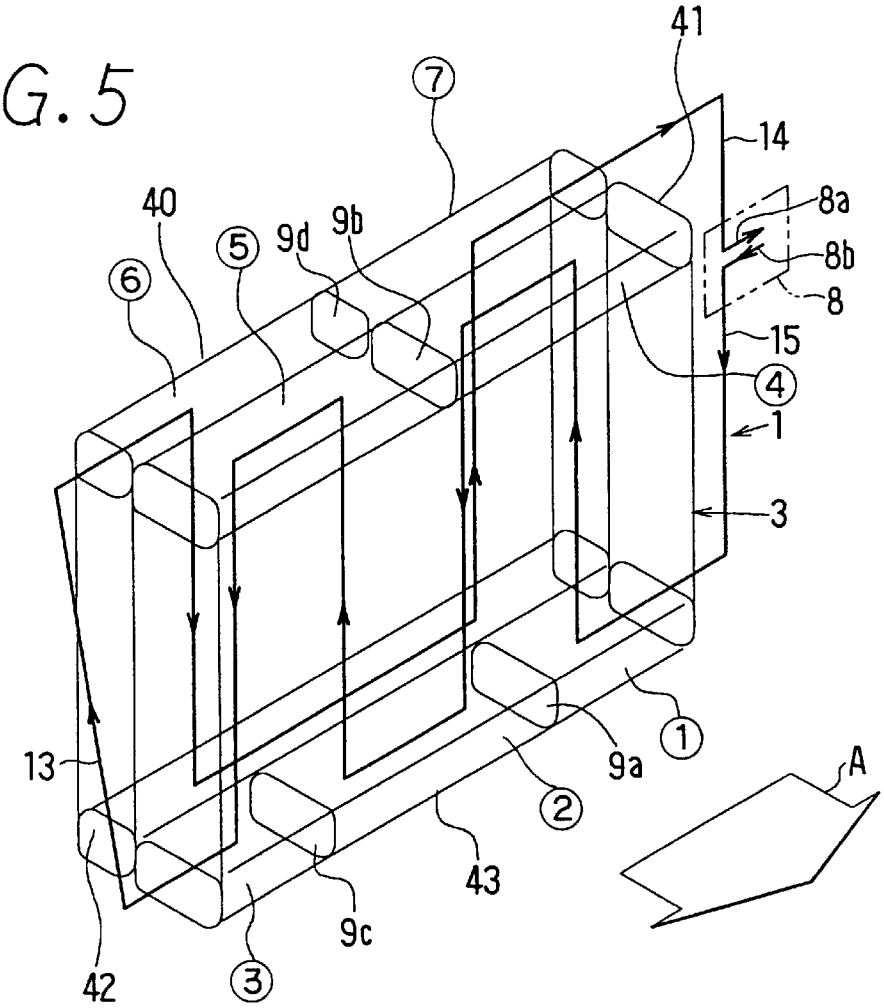
FIG. 5 is an explanatory view showing a refrigerant path in the evaporator shown in FIG. 1.

FIG. 5 shows a refrigerant path in the evaporator 1. Partition members 9*a*–9*d* are disposed in the tank portions 40, 42 on the air upstream side and in the tank portions 41, 43 on the air downstream side. Accordingly, the tank portions 40–43 are divided into ①–⑦ parts, and the refrigerant flows while U-turning in the evaporator 1 as indicated with solid line arrows in the figure.

Specifically, the low pressure gas-liquid two-phase refrigerant, the pressure of which has been reduced by the expansion valve, flows into the refrigerant inlet hole 8*b* of the piping joint 8, and flows in the following route. That is, the refrigerant flows from the inlet hole 8*b* to the outlet hole 8*a* via the side refrigerant passage 15→the first tank portion ① of the lower side tank portion 43 on the air downstream side→the refrigerant passage 48 on the air downstream side within the tubes 2→the first tank portion ④ of the upper side tank portion 41 on the air downstream side→the refrigerant passage 48 on the downstream side within the tubes 2→the second tank portion ② of the lower side tank portion 43 on the air downstream side→the refrigerant passage 48 on the air downstream side within the tubes 2→the second tank portion ⑤ of the upper side tank portion 41 on the air downstream side→the refrigerant passage 48 on the downstream side within the tubes 2→the third tank portion ③ of the lower side tank portion 43 on the air downstream side→the side refrigerant passage 13→the first tank portion ⑥ of the upper side tank portion 40 on the air upstream side→the refrigerant passage 47 on the upstream side within the tubes 2→the lower side tank portion 42 on the upstream side→the refrigerant passage 47 on the upstream side within the tubes 2→the second tank portion ⑦ of the upper side tank portion 40 on the upstream side→the side refrigerant passage 14→the refrigerant outlet hole 8*a*, in this order. The refrigerant path described above is disclosed in JP-A-9-170850. When the refrigerant flows in the path while U-turning, heat exchange between the refrigerant and the blown air passing through the heat exchange part 3 is performed through the inner fins 49, 50, the metallic thin plates 4, the end plates 60, 62, and the corrugated fins 5 so that the refrigerant evaporates. Incidentally, FIG. 2 shows the thin plate 4 which is disposed the most adjacently to the side refrigerant passage 13 as an example. Therefore, in the thin plate 4 shown in FIG. 2, the upper side tank portions 40, 41 serve as the inlet side tank and the lower side tank portions 42, 43 serve as the outlet side tank portion.

Next, features and effects in the first embodiment will be explained. The inner fins 49, 50 are respectively disposed in the refrigerant passages 47, 48 within the tubes 2 so that the refrigerant passages 47, 48 are divided into many independent subpassages 49*a*, 50*a* by the inner fins 49, 50. Accordingly, in FIG. 2, the refrigerant is distributed into the subpassages 49*a*, 50*a* from the inlet side tank portions 40, 41, independently flows in the respective subpassages 49*a*, 50*a* downward, and meet again in the outlet side tank portions 42, 43.

Here, in the refrigerant passage 47 on the upstream side and in the refrigerant passage 48 on the downstream side, the cross-sectional areas of the communicating portions 51–54 provided on the air upstream side in the air flow direction A are larger than those of the communicating portions 55–58 provided on the air downstream side. Therefore, the flow resistance in the communicating portions 51–54 on the air upstream side is smaller than that in the communicating portions 55–58 on the air downstream side.

As a result, when the refrigerant is distributed into the inner fin subpassages 49*a*, 50*a*, a distribution amount of the refrigerant distributed into the subpassages 49*a*, 50*a* on the air upstream side can be controlled to be larger than that on the air downstream side. Therefor, even if the temperature of the air gradually decreases from the upstream side to the downstream side so that heat load on the air side gradually decreases from the air upstream side to the air downstream side, the distribution amounts of the refrigerant can be appropriately controlled on both air upstream and downstream sides of the inner fin subpassages 49*a*, 50*a*.

Accordingly, even in the case where the refrigerant independently flows in the many inner fin subpassages 49*a*, 50*a*, the refrigerant can be appropriately distributed into the respective subpassages 49*a*, 50*a* with the distribution amounts neither too much nor too little. That is, the communicating portions 55–58 on the sir downstream side having large flow resistance restrict the refrigerant amount distributed into the subpassages 49*a*, 50*a* on the air downstream side. As a result, the refrigerant is prevented from excessively flowing on the air downstream side. Simultaneously, the refrigerant amount flowing in the subpassages 49*a*, 50*a* on the air upstream side is increased due to the communicating portions 51–54 on the air upstream side having small flow resistance, and accordingly the shortage of the refrigerant on the air upstream side is prevented.

In this way, because the shortage of the refrigerant on the air upstream side is prevented, the gas region in the subpassages 49*a*, 50*a* on the air upstream side is reduced. Consequently, entire cooling capacity of the evaporator is improved. Also, because the communicating portions 51–54 having the small flow resistance are provided on the air upstream side, the pressure loss in the entire evaporator 1 can be prevented from increasing to prevent malfunctions such as decrease in cooling capacity, which is caused by rise in refrigerant evaporator temperature caused by rise in evaporation pressure.

Also, in the first embodiment, as shown in FIGS. 2, 4A, width $W_2$ of each of the tank portions 40–43 is sufficiently smaller than width $W_1$ of each of the refrigerant passages 47, 48. For example, the widths $W_1$, $W_2$ has a relationship of $W_2$=0.6 $W_1$. If the widths of the tank portions 40–43 are increased to have large pressure receiving areas, a large load is applied to the peripheral portions of the tank portion to decrease a withstand pressure strength thereof. As opposed to this, in the first embodiment, because the widths $W_1$, $W_2$ has the relationship of $W_1>W_2$, the peripheral portions of the tank portions 40–43 have large withstand pressure strength. Simultaneously, because the corrugated inner fins 49, 50 are securely joined to the inside wall of the concave portions 46 at the folded top portions thereof in a wide range, the withstand pressure strength of the tubes 2 forming the refrigerant passages 47, 48 are also improved. Consequently, as a whole, the evaporator 1 has sufficient pressure withstand strength.

Further, according to the constitution in the first embodiment, as shown in FIG. 4B, the embossed height of the thin plates 4 for forming the communicating portions 55–58 is smaller than that of the concave portions 46 for accommodating the inner fins 49, 50. Accordingly, when the inner fins 49, 50 are assembled, the positioning of the inner fins 49, 50 can be accurately carried out using steps provided by the difference in embossed height described above, without having positioning deviation. Therefore, inner fins 49, 50 can be joined to one another not to decrease the withstand pressure strength. This results in enhancement of the withstand pressure strength of the evaporator and in improvement of the evaporator property.

In addition, because the refrigerant is appropriately distributed into the subpassages 49*a*, 50*a* due to the communicating portions 51–58 provided between the inlet and outlet portions of the subpassages 49*a*, 50*a* and the tank portions 40–43, it is not necessary that the shapes of the subpassages 49*a*, 50*a*, and of the tank portions 43–43 are made to be different on the air upstream side and on the air downstream side.

(Second Embodiment)

Figure 6:
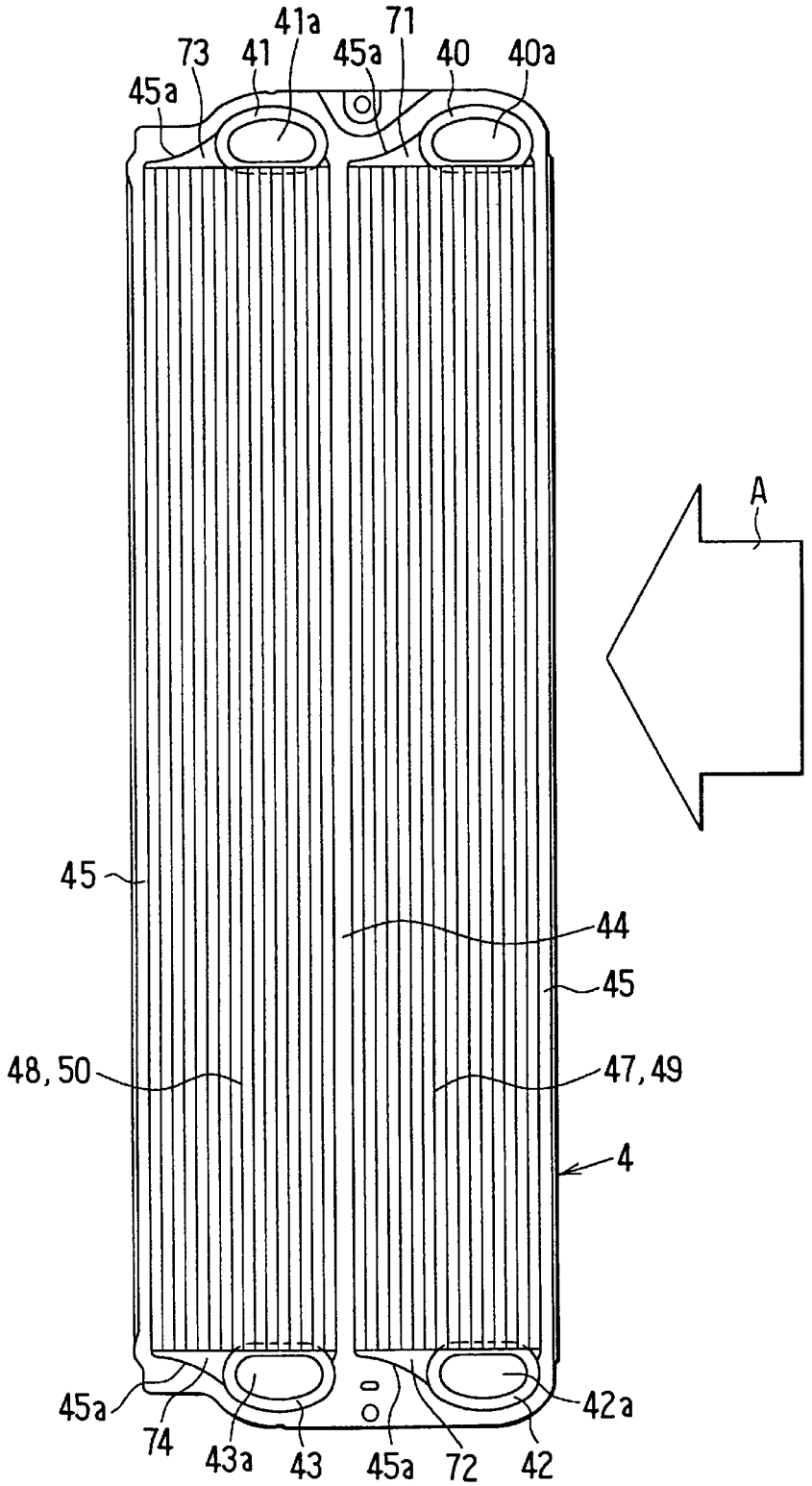
FIG. 6 is a front view showing a metallic thin plate in a second preferred embodiment.

FIG. 6 shows a metallic thin plate 4 in a second preferred embodiment. In the first embodiment, the tank portions 40–43 are provided at the central portions of the refrigerant passage 47 on the air upstream side and of the refrigerant passage 48 on the air downstream side in the width direction ($W_1$ direction), respectively. As opposed to this, in the second embodiment, the tank portions 41–43 are offset from the central portions of the refrigerant passages 47, 48 toward the air upstream side in the width direction.

As a result, the refrigerant directly flows into the subpassages 49*a*, 50*a* on the air upstream side from the inlet side tank portions 40, 41. On the other hand, on the air downstream side, the refrigerant flows into the subpassages 49*a*, 50*a* through the communicating portions 71, 73, flows out from the subpassages 49*a*, 50*a* through the communicating portions 72, 74, and enters the outlet side tank portions 42, 43. In this way, according to the second embodiment, because the refrigerant flows into and out from the inner fin subpassages 49*a*, 50*a* on the air downstream side through communicating portions 71–74, the flow resistance of the refrigerant flowing in the subpassages 49*a*, 50*a* on the air downstream side is larger than that flowing in the subpassages 49*a*, 50*a* on the air upstream side. As a result, the refrigerant is prevented from being excessively distributed into the subpassages 49*a*, 50*a* on the air downstream side. Simultaneously, the amount of the refrigerant distributed into the subpassages 49*a*, 50*a* on the air upstream side is increased to prevent the shortage of the refrigerant on the air upstream side. As a result, the refrigerant can be appropriately distributed into the subpassages 49*a*, 50*a* on the air upstream side and on the air downstream side neither too much nor too little.

Also, in the second embodiment, tapered faces 45*a* are provided parts of the outer peripheral joining portions 45 to form the outer peripheral edge portions of the communicating portions 71–74. The tapered faces 45*a* are concave inwardly. Therefore, the inner fins 49, 50 can be accurately positioned using the edge portions of the tapered faces 45*a* when they are assembled. The other features and effects are the same as those in the first embodiment.

(Third Embodiment)

Figure 7A:
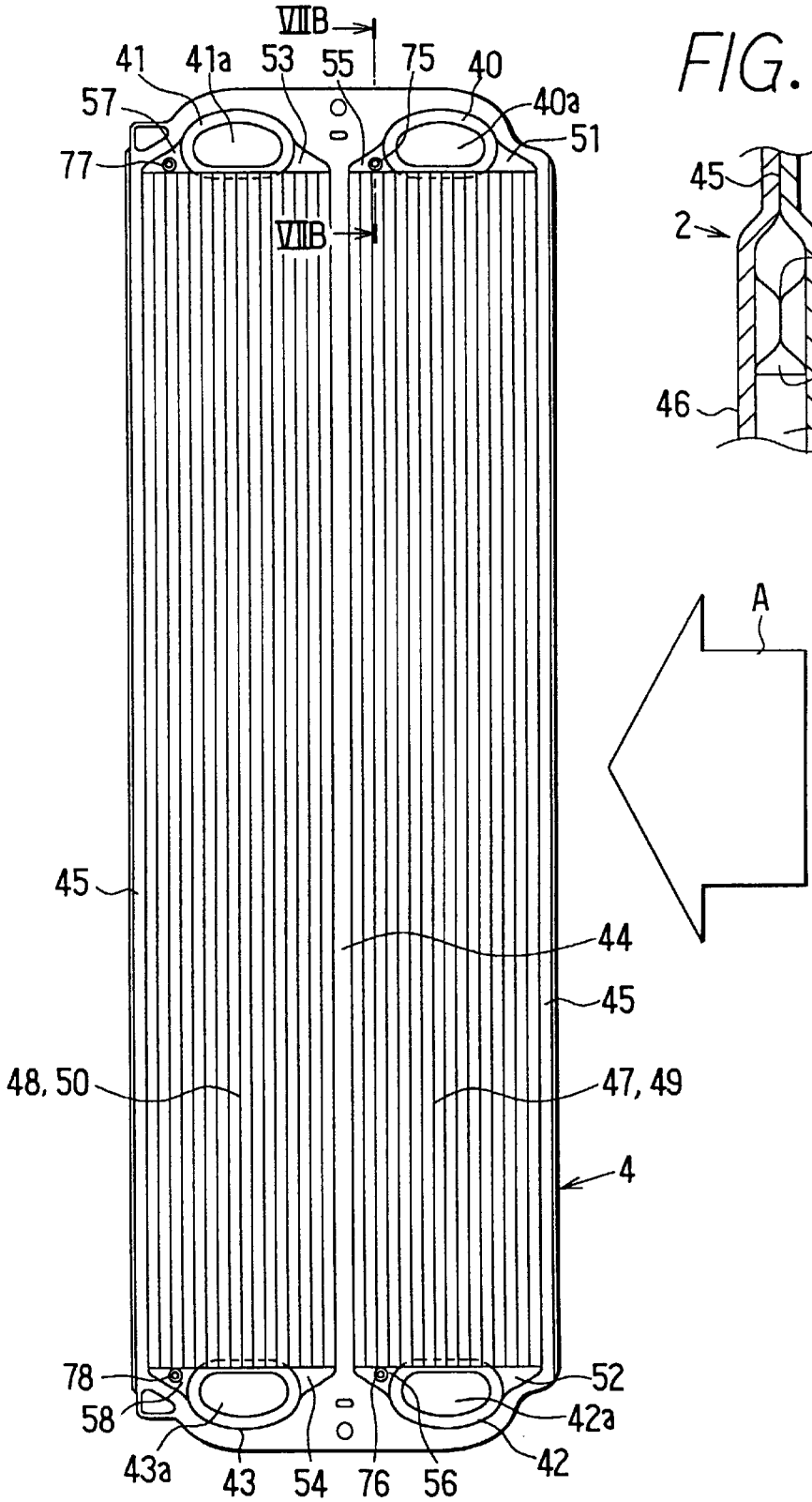
FIG. 7A is a front view showing a metallic thin plate in a third preferred embodiment.
Figure 7B:
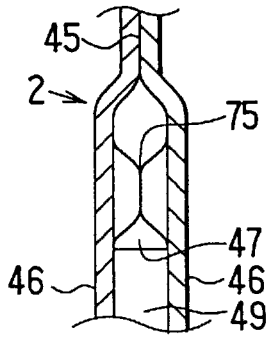
FIG. 7B is a cross-sectional view taken along a VIIB—VIIB line in FIG. 7A.

FIGS. 7A, 7B show a metallic thin plate 4 in a third preferred embodiment, which is modified from that of the first embodiment. That is, only the communicating portions 55–58 provided on the air downstream side of the communicating portions 51–58 are formed with resistive members 75, 78, respectively, so that the communicating portions 55–58 on the air downstream side have flow resistance larger than that of the communicating portions 51–54 on the air upstream side. The resistive members 75–78 are, as specifically shown in FIG. 7B, formed with circular protrusions embossed inwardly from the bottom surfaces of the concave portions 46 of the thin plate 4. The circular protrusions contacts one another at top portions thereof. According to the constitution in the third embodiment, the same effects as those in the first embodiment can be provided. Incidentally, the positioning of the inner fins 49, 50 when assembled can be accurately carried out using the resistive members 75–78. The other features are the same as those in the first embodiment.

(Fourth Embodiment)

Figure 8:
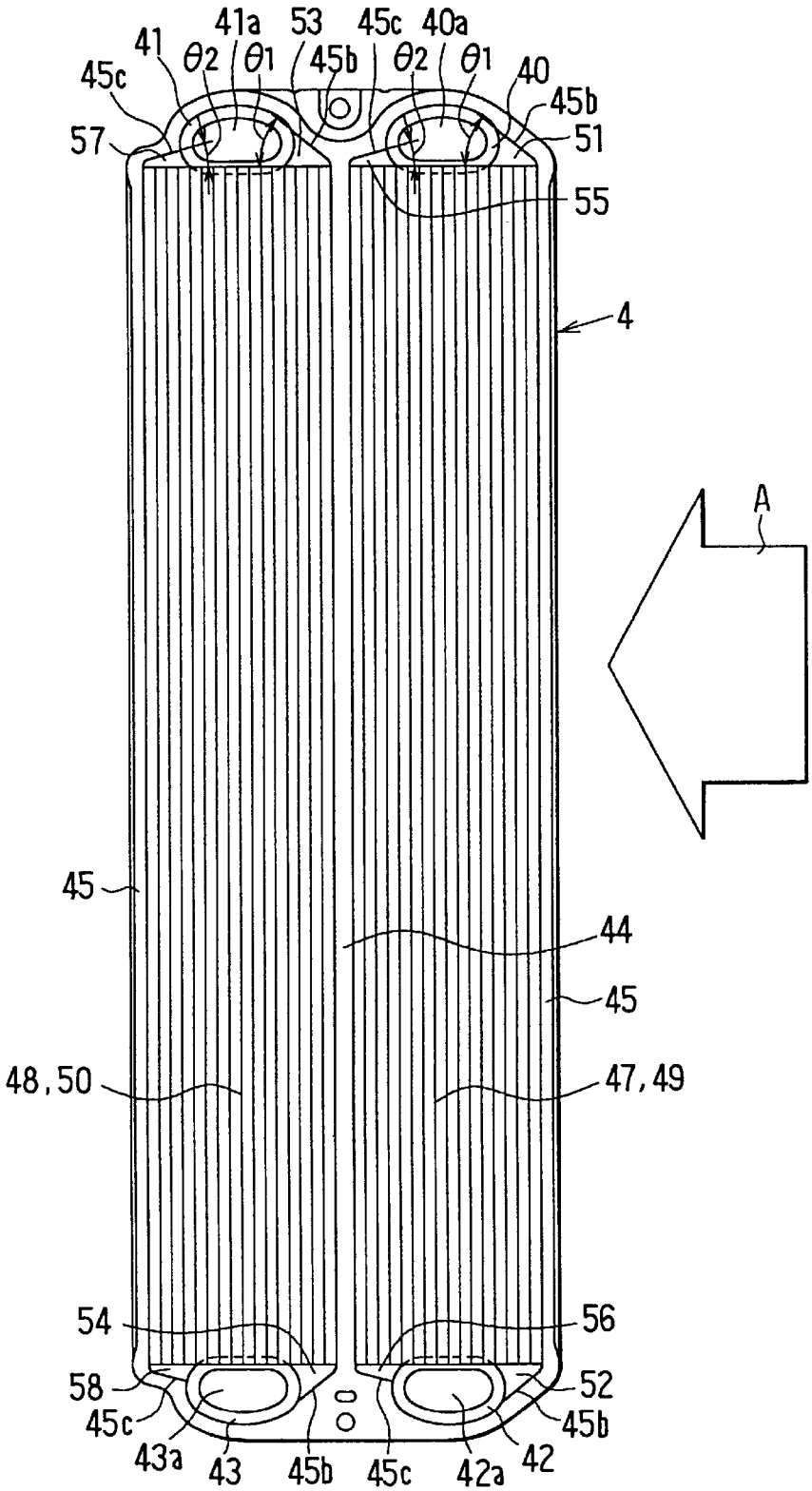
FIG. 8 is a front view showing a metallic thin plate in a fourth preferred embodiment.

FIG. 8 shows a metallic thin plate 4 in a fourth preferred embodiment. In the fourth embodiment, as in the first and third embodiment, the tank portions 40–43 are arranged at the respective central portions of the refrigerant passages 47, 48 in the width direction ($W_1$ direction). In this arrangement, in the fourth embodiment, tapered faces 45*b*, 45*c* having inclinations $\theta_1$, $\theta_2$ are provided at parts of the outer peripheral joining portions 45 to form the outer peripheral edge portions of the communicating portions 51–58. The inclinations $\theta_1$, $\theta_2$ are determined in the following way.

That is, the inclination $\theta_1$ of the tapered faces 45*b* of the communicating portions 51–54 on the upstream side (the inclination with respect to longitudinal direction edge faces of the inner fins 49, 50) is set to be larger than the inclination $\theta_2$ of the tapered faces 45*c* of the communicating portions 55–58 on the air downstream side (the inclination with respect to the longitudinal direction edge faces of the inner fins 49, 50). That is, the inclinations $\theta_1$, $\theta_2$ has a relationship of $\theta_1 > \theta_2$.

Accordingly, the communicating portions 51–54 on the air upstream side have flow resistance larger than that of the communicating portions 55–58 on the air downstream side. As a result, the distribution amount of the refrigerant distributed into the inner fin subpassages 49*a*, 50*a* on the air upstream side can be increased, while the distribution amount of the refrigerant distributed into the subpassages 49*a*, 50*a* on the air downstream side can be decreased. Thus, the same effects as those in the embodiment described above can be provided. Incidentally, as a specific design example, it is desirable that the inclination $\theta_1$ is in a range of 20° to 45° ($20° \leqq \theta_1 \leqq 45°$), and the inclination $\theta_2$ is in a range of 0° to 30° ($0° \leqq \theta_2 \leqq 30°$). The positioning of the inner fins 49, 50 can be performed using the edge portions of the tapered faces 45*b*, 45*c*.

(The other Embodiments)

It is apparent that the structure forming the refrigerant passages of the evaporator 1 can be modified, provided that the refrigerant can be appropriately distributed into the subpassages 49*a*, 50*a*. For example, the present invention is applied to the evaporator in which each tube 2 is divided into two refrigerant passages 47, 48; however, the present invention may be applied to an evaporator in which only one refrigerant passage is formed in a tube. Although the tube 2 (metallic thin plate 4) has the tank portions 40–43 at the both ends thereof, the tube 2 (metallic thin plate 4) may have tank portions only at one end so that the refrigerant u-turns at the other end in the longitudinal direction thereof.

While the present invention has been shown and described with reference to the foregoing preferred embodiments, it will be apparent to those skilled in the art that changes in form and detail may be made therein without departing from the scope of the invention as defined in the appended claims.

What is claimed is:

1. A lamination type heat exchanger comprising:

a pair of thin plates joined to form a fluid passage for exchanging heat between fluid flowing in the fluid passage in a longitudinal direction of the pair of thin plates and air flowing outside of the fluid passage;

an inner fin disposed in the fluid passage and dividing the fluid passage into a plurality of subpassages which are arranged in an air flow direction in which the air flows, the plurality of subpassages including an upstream side subpassage and a downstream side subpassage which is provided on a downstream side more than the upstream side subpassage in the air flow direction;

an inlet tank portion integrally provided at a first end of the pair of thin plates in the longitudinal direction and communicating with the plurality of subpassages for distributing the fluid into the plurality of subpassages;

an outlet tank portion integrally provided at a second end of the pair of thin plates on an opposite side of the first end and communicating with the plurality of subpassages for collecting the fluid from the plurality of subpassages; and a fluid distribution controlling portion provided between the inlet tank portion and the plurality of subpassages for controlling first and second amounts of the fluid respectively distributed into the upstream side and downstream side subpassages such that the second amount of the fluid distributed into the downstream side subpassage is smaller than the first amount of the fluid distributed into the upstream side subpassage.

2. The lamination type heat exchanger of claim 1, wherein a width of the inlet tank portion in a direction perpendicular to the longitudinal direction is smaller than that of the fluid passage.

3. The lamination type heat exchanger of claim 1, wherein the inner fin is a corrugated fin.

4. The lamination type heat exchange of claim 1, wherein the inner fin is positioned in the longitudinal direction in the fluid passage by the fluid distribution controlling portion.

5. The lamination type heat exchanger of claim 1, wherein:

the fluid distribution controlling portion is a communicating portion provided between the inlet tank portion and the fluid passage;

the communicating portion has a first communicating portion directly communicating with the upstream side subpassage and a second communicating portion directly communicating with the downstream side subpassage; and the first communicating portion has a flow resistance of the fluid smaller than that of the second communicating portion.

6. The lamination type heat exchanger of claim 5, wherein:

the first communicating portion is formed by a first tapered face having a first inclination with respect to the longitudinal direction; and the second communicating portion is formed by a second tapered face having a second inclination with respect to the longitudinal direction smaller than the first inclination.

7. The lamination type heat exchanger of claim 1, wherein:

the inlet tank portion is offset toward the upstream side in the air flow direction from a central portion in a width direction of the pair of thin plates; and the fluid distribution controlling portion is provided only on the downstream side in the air flow direction with respect to the inlet tank portion.

8. The lamination type heat exchanger of claim 1, wherein:

the fluid distribution controlling portion is a resistive member for restricting the fluid from being introduced into the fluid passage, the resistive member being provided in a communicating portion between the inlet tank portion and the fluid passage on the downstream side with respect to the inlet tank portion in the air flow direction.

9. A lamination type heat exchanger comprising:

a pair of thin plates joined to form a fluid passage for exchanging heat between fluid flowing inside of the fluid passage in a longitudinal direction of the pair of thin plates and air flowing outside of the fluid passage;

an inner fin disposed in the fluid passage for increasing a heat transfer area on a fluid side;

an inlet tank portion integrally provided at a first end of the pair of thin plate in the longitudinal direction and communicating with the fluid passage for introducing the fluid into the fluid passage;

an outlet tank portion integrally provided at a second end of the pair of thin plates in the longitudinal direction and communicating with the fluid passage for receiving the fluid from the fluid passage; and a fluid distribution controlling portion provided between the inlet tank portion and the fluid passage for controlling distribution of the fluid such that an amount of the fluid distributed into a first passage portion of the fluid passage is larger than that distributed into a second passage portion of the fluid passage, the first passage portion being provided on an upstream side in an air flow direction more than the second passage portion, wherein the inner fin is positioned in the fluid passage in the longitudinal direction by the fluid distribution controlling portion.

10. The lamination type heat exchanger of claim 9, wherein:

the fluid distribution controlling portion is a communicating portion provided between the inlet tank portion and the fluid passage;

the communicating portion has a first communicating portion directly communicating with the first passage portion and a second communicating portion directly communicating with the second passage portion; and the first communicating portion has a flow resistance of the fluid smaller than that of the second communicating portion.

11. The lamination type heat exchanger of claim 10, wherein:

the first communicating portion is formed by a first tapered wall having a first inclination with respect to the longitudinal direction; and the second communicating portion is formed by a second tapered wall having a second inclination with respect to the longitudinal direction smaller than the first inclination.

12. The lamination type heat exchanger of claim 9, wherein:

the inlet tank portion is offset toward the upstream side in the air flow direction from a central portion in a width direction of the pair of thin plates; and the fluid distribution controlling portion is provided only on the downstream side in the air flow direction with respect to the inlet tank portion.

13. The lamination type heat exchanger of claim 9, wherein:

the fluid distribution controlling portion is a resistive member for restricting the fluid from being introduced into the fluid passage, the resistive member being provided in a communicating portion between the inlet tank portion and the fluid passage on the downstream side with respect to the inlet tank portion in the air flow direction.

14. A lamination type heat exchanger comprising:

a pair of thin plates joined to form a fluid passage for exchanging heat between fluid flowing inside of the fluid passage in a longitudinal direction of the pair of thin plates and air flowing outside of the fluid passage;

an inner fin disposed in the fluid passage and dividing the fluid passage into a plurality of subpassages parallel to one another, the plurality of subpassages including a first group of subpassages provided on an upstream side in an air flow direction, a second group of subpassages provided on a downstream side in the air flow direction more than the first group of subpassages, and a third group of subpassages provided between the first and second groups of subpassages;

an inlet tank portion integrally formed with a first end portion of the pair of thin plates in the longitudinal direction and communicating with the plurality or subpassages for introducing the fluid into the plurality of subpassages, the inlet tank portion being provided at a position directly communicating with the third group of subpassages; and an outlet tank portion integrally formed with a second end portion of the pair of thin plates on a side opposite to the first end portion in the longitudinal direction and communicating with the plurality of subpassages for receiving the fluid from the plurality of subpassages, wherein the pair of thin plates defines a first communicating portion connecting the first group of subpassages and the inlet tank portion therebetween and a second communicating portion connecting the second group of subpassages and the inlet tank portion therebetween, the first communicating portion having a flow resistance of the fluid smaller than that of the second communicating portion.

15. The lamination type heat exchanger of claim 14, wherein a gap between the pair of thin plates forming the first communicating portion is larger than that forming the second communicating portion.

* * * * *